United States Patent [19]

Barlow

[11] 4,129,967

[45] Dec. 19, 1978

[54] APPARATUS FOR COLLECTING FLUID SEEPAGE IN A BUILDING STRUCTURE

[75] Inventor: Robert M. Barlow, Great Falls, Va.

[73] Assignee: John D. VanWagoner, a part interest

[21] Appl. No.: 805,318

[22] Filed: Jun. 10, 1977

[51] Int. Cl.[2] ..... E04D 13/04; E04B 1/68

[52] U.S. Cl. ..... 52/15; 52/396; 404/69

[58] Field of Search ..... 404/67, 68, 69, 47, 404/165; 160/392, 397; 52/11, 15, 396, 471, 533, 459, 396

[56] References Cited

U.S. PATENT DOCUMENTS

| | | | |
|---|---|---|---|
| 2,950,727 | 8/1960 | Dunn | 160/392 |
| 3,057,117 | 10/1962 | Singer | 52/11 |
| 3,143,165 | 8/1964 | Lewis et al. | 160/392 |
| 3,849,958 | 11/1974 | Balzer et al. | 52/396 |
| 4,028,861 | 6/1977 | Huddle | 52/63 |

FOREIGN PATENT DOCUMENTS

| | | | |
|---|---|---|---|
| 2449624 | 5/1975 | Fed. Rep. of Germany | 52/11 |
| 734376 | 7/1955 | United Kingdom | 52/459 |

*Primary Examiner*—James L. Ridgill, Jr.
*Attorney, Agent, or Firm*—Bradford E. Kile; Charles L. Gholz

[57] ABSTRACT

An apparatus for collecting fluid seepage in a building structure or the like wherein the structure is constructed with generally horizontal slabs having separations therein, such as expansion joints and/or shrinkage cracks, settlement cracks, stress cracks or the like. The apparatus includes first and second elongate barrier strips operably positionable along opposite sides of the separation. A flexible collection sheet is hung from mounting channels on the outer edges of the barrier strips. Drip contour lips are fashioned upon the inner edges of the barrier strips and serve to direct fluid seepage passing through the expansion joint, stress crack, or the like, into the collection sheet.

8 Claims, 3 Drawing Figures

APPARATUS FOR COLLECTING FLUID SEEPAGE IN A BUILDING STRUCTURE

BACKGROUND OF THE INVENTION

This invention relates to an apparatus for collecting fluid seepage in a building structure or the like. More particularly the invention relates to an apparatus for collecting fluid seepage occuring at locations of separation in structural slabs such as at expansion joints, and/or shrinkage cracks, settlement cracks, stress cracks or the like.

In the construction industry, office buildings, plaza decks, etc. are constructed with generally horizontal monolithic concrete, or other slab materials. In order to accomodate temperature expansion and contraction, these structural slabs are designed with periodic separations. The separations are then bridged by expansion joints which permit relative movement between the slabs.

Although a wide variety of expansion joint designs are known in the art, most expansion joints include a metallic bridge plate designed to be wide enough to bridge the gap between juxtaposed slabs. One portion of the bridge plate is fixedly mounted upon an edge of one slab and translatable rests upon a bearing plate mounted upon the edge of the juxtaposed slab. As the slabs expand and contract, the bridge plate slides back and forth above the separation and thus provides surface structural continuity in the building structure.

When expansion joints are placed in roofing sections of a building or in deck areas covering underground malls, a flexible sheet or resilient plug is interposed between adjacent slabs to provide a fluid barrier across the slab separations. This fluid barrier is necessary to prevent water or fluid from leaking through the expansion joint and damaging interior ceiling structures located beneath the slabs.

While such expansion joints theoretically are structurally sound and water tight, leakage through the expansion joint inevitably developes. In this regard, in some instances, the flexible sheet or resilient plug may not have initially been installed correctly. In other cases, the water-barrier material may decompose or fail with age. Additionally, where three or four slabs meet at corner junctions. Unexpected contraction or settling of the slabs may tear or rupture the water barrier. At any rate, and for whatever reason, those skilled in the art will appreciate that a substantial degree of difficulty is encountered in trying to maintain the water or fluid tight integrity of expansion joints. Moreover, once an expansion joint is installed, it is extremely difficult and often impractical to either repair or replace the water barrier means employed in the joint design.

In addition to water seepage through expansion joints, buildings and decks constructed with monolithic-concrete slabs and the like, sometimes experience at least a degree of settling or shrinkage. If the concrete reinforcing network has not been precisely positioned during construction such settling may create irregular stress cracks in the structural slabs. Once stress cracks develope, it is again extremely difficult to reestablish water-tight integrity of the structure.

Although expansion joint and stress crack seepage and damage is troublesome in connection with the roofs of buildings and deck areas, such problems are significantly exacerbated in multilevel parking garages. In this connection, cars entering a garage are often wet from rain or snow. When the cars are parked, at any level, the rain water drips from the car or the snow melts and drips onto the concrete slab below. Accordingly wet conditions often exist at every level in the garage.

Water on the garage decks then tends to seep into and through expansion joints and/or stress cracks and run by capillary action along the ceiling structure above parked cars. Eventually, the water film coalesces into a droplet which falls onto a parked car. In some instances, this seeping water picks up and carries mineral deposits which may damage the automobile finish. Although such water damage may subject a garage owner to liability, it is extremely difficult, as previously noted, to reestablish water-tight integrity of a monolithic slab structure once leakage exists.

Accordingly, in those instances where water damage has been encountered or is reasonably foreseeable, owners have sought to alleviate such difficulties by hanging metal troughs beneath the expansion joints or stress cracks. The troughs are fabricated in sections and soldered together at a work site into an integral gutter system which drains into a common down pipe.

While such a metal gutter system has achieved at least a degree of industry recognition and utilization, room for significant improvement remains. In this regard, such gutter systems are initially expensive to install. The materials are expensive and skilled laborers are required to fit and solder the sections together. Once installed, such a system is difficult to take apart and clean. Further, it is difficult to hang a metal gutter system beneath irregular stress cracks because of the stiffness of the material. Most significantly, it is difficult to prevent water seeping through expansion joints and cracks from running along the ceiling by capillary action and away from an underlying trough.

The problems suggested in the preceeding are not intended to be exhaustive, but rather are among many which may tend to reduce the effectiveness of prior systems. Other noteworthy problems may also exist in connection with water or fluid seepage and attempts to collect the water in building structures. However, those difficulties outlined above should be sufficient to demonstrate that significant water seepage problems and difficulties exist in the building construction industry.

OBJECTS AND SUMMARY OF THE INVENTION

It is therefore a general object of the invention to provide an apparatus for collecting fluid seepage in a building structure which will alleviate or minimize problems of the type previously described.

It is a particular object of the invention to provide an apparatus for collecting fluid seepage in a building structure which may be facilely, quickly and relatively inexpensively installed.

It is another object of the invention to provide an apparatus for collecting fluid seepage in a building structure which may be readily serviced and cleaned.

It is yet another object of the invention to provide an apparatus for collecting fluid seepage in a building structure which may be facilely applied beneath an irregular crack in a structural slab.

It is a further significant object of the invention to provide an apparatus for collecting fluid seepage in a building structure which will prevent fluid from running away from the apparatus by capillary action along a ceiling.

It is yet a further object of the invention to provide apparatus for collecting fluid seepage in a building structure wherein flexible collection means of different thicknesses may be conveniently employed.

BRIEF SUMMARY OF THE INVENTION

An apparatus in accordance with a preferred embodiment of the invention which is intended to accomplish at least some of the foregoing objects comprises first and second barrier strips which may be mounted upon a bottom surface of a monolithic concrete slab on either side of a separation in the slab such as an expansion joint, a stress crack or the like. The barrier strips are fashioned with a retaining channel running along one edge of said strips remote from the separation in the slab. The barrier strips are further fashioned with drip contour means running along an inner edge of said strips. A flexible receiving sheet is connected between said retaining channels and thus operably underlies the separation in said slab.

Accordingly any water or fluid which may seep through an expansion joint or structural crack in the concrete slab will encounter the drip contour of either said first or second barrier strip, coalesce into a droplet and fall into said flexible receiving channel to be directed away to a common collection means such as a downspout or container.

THE DRAWINGS

Other objects and advantageous of the present invention will become apparent from the following detailed description of a preferred embodiment taken in conjunction with the accompanying drawings, wherein.

DETAILED DESCRIPTION

Figure 1:
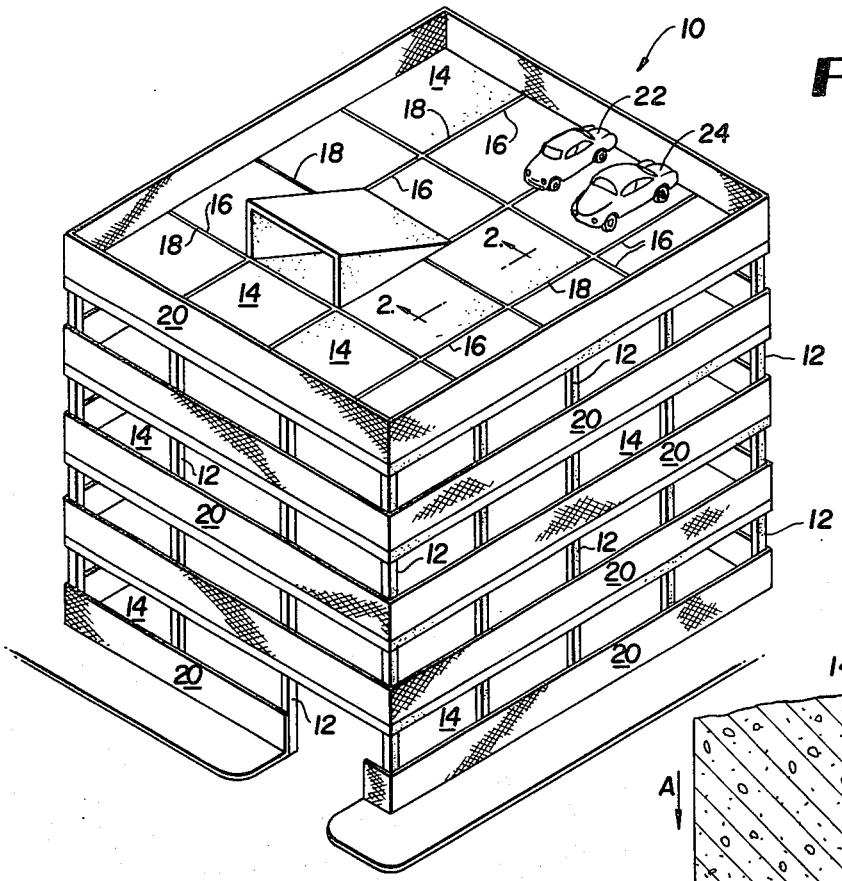
FIG. 1 is an oxonometric view of a parking garage which forms one operative environment for the present invention.

Referring now to the drawings wherein like numerals designate like parts FIG. 1 discloses a multilevel parking garage 10 constructed with generally vertical concrete columns 12 which serve to support and carry a plurality of generally horizontal structural slabs 14 at each level of the garage.

The slabs 14 are poured from monolithic concrete during construction and are intermittently separated as at locations 16 to permit temperature expansion and contraction. In order to accomodate such expansion each of the separations 16 are fitted with an expansion joint 18, note FIG. 2.

A barrier rail 20 extends around the garage at each deck level to prevent vehicles such as cars 22 and 24 from being driven or coasting off a parking deck.

A parking garage 10 has been depicted in FIG. 1 merely because the subject invention finds particular utility in such building structures. The subject invention may also, however, be advantageously employed at the roof level of office buildings, beneath plaza decks, etc. as previously described.

Figure 2:
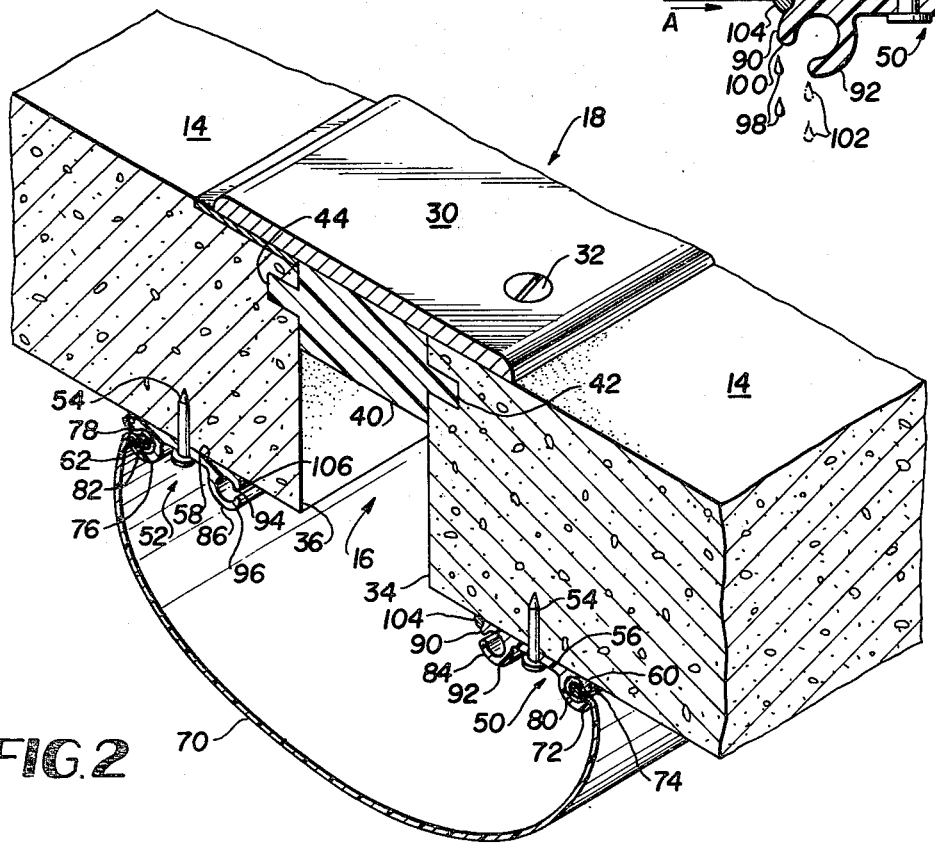
FIG. 2 is a cross-sectional view taken along section line 2—2 in FIG. 1 and depicts the subject invention mounted beneath a separation in a concrete building slab.

Referring now to FIG. 2 there will be seen a detailed view of a preferred embodiment of the subject invention positioned beneath an expansion joint 18.

The expansion joint includes a bridging plate 30 which is fixedly connected by screws 32 or the like to one edge 34 of a slab 14. The other edge 36 of slab 14 includes a bearing plate 38 which extends therealong. The bridging plate 30 is dimensioned to be wide enough to extend across a separation 16 in the slab 14 and rests for translation upon the bearing plate 38. Accordingly, as the slab expands and contracts the separation 16 will remain covered.

In addition to structural continuity an expansion joint typically is designed with a resilient plug 40 or the like which may fit between adjacent slabs via a tongue and groove connecting arrangement as at 42 and 44. Although such expansion joint structures appear to be water tight, seepage inevitably exists, as previously noted.

The subject invention comprises first and second elongated barrier stripe means 50 and 52 respectively positioned along opposite sides of the separation 16. The barrier strips 50 and 52 are mounted upon the bottom surfaces of the slab 14 through the provision of mounting means such as studs 54 or the like.

The barrier strips 50 and 52 may be extruded from plastic or metallic compositions as desired and include elongate base members 56 and 58 respectively. Each barrier strip is also provided with generally C-shaped retaining members 60, 62 which extend coextensively along an outer edge of the barrier strips 56 and 58.

A flexible receiving member 70 extends along the barrier strips 50 and 52 and includes edge portions which are intimately received in frictional engagement within lips 72, 74, and 76, 78 of the retainer members 60 and 62 respectively. In order to enhance frictional engagement between the flexible receiving member 70 and the C-shaped retaining members 60 and 62 locking wires 80 and 82 may be fitted within the retaining members as depicted in FIG. 2.

The flexible receiving member 70 may be fabricated from a variety of materials such as reinforced neoprene, polyethylene, polyurethane or polyvinyl chloride sheets and the like.

The barrier strips 50 and 52 further include drip contour members 84 and 86 having arcuate lips 90, 92 and 94, 96 longitudinally extending along an inner edge of said strips respectively. These arcuate contour lips serve to induce seeping water to coalesce into droplets and not run along the bottom surface of the slab 14.

Figure 3:
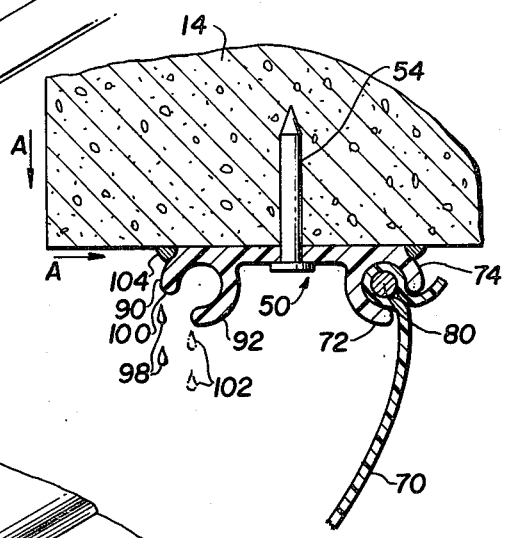
FIG. 3 is a detailed cross-sectional view of one barrier strip disclosing the function of drip contour lips.

In this connection, and with reference to FIG. 3, water seeping through a separation 16 in the direction of arrows "A" will encounter a first arcuate lip 90 and coalesce into droplets 98 which will fall by gravity into the receiving member 70. In the event any fluid is able to pass the tip 100 of acuate lip 90 it will have to proceed against gravity upwardly and then encounter a second arcuate drip inducing lip 92 where the water film will again coalesce into droplets 102.

The combination of mutually facing arcuate lips 90 and 92 has been found to act as an extremely effective barrier to the passage of water by capillary action past the barrier strip.

In order to further enhance the water tight integrity of each barrier strip sealant strips 104 and 106 are laid down between the bottom of slab 14 and first and second drip contour means 84 and 86 respectively.

Moreover, it has been determined that the drip contour means and the retaining means synergistically may be fabricated with similar cross-sectional shapes but with different radii of curvature of the lips thereof such that a different thickness receiving means 70 may be accommodated merely be altering the side of the separation 16 upon which each barrier strip is mounted.

In describing an apparatus for collecting fluid seepage in a building structure or the like in accordance with a preferred embodiment of the invention those skilled in the art will recognize several advantages which singularly distinguish the instant invention from previously known devices.

A particular advantage of the invention entails the use of inexpensive materials such as extruded metallic or plastic barrier strips and a flexible receiving sheet. Such members are not only inexpensive to purchase but are also easily and readily handled without special tools.

Additionally, in the event the flexible receiving member becomes clogged with dirt it may be facilely removed and cleaned or replaced. Further the lateral flexibility of the instant structure enables one to install the structure beneath irregular stress cracks in a slab.

A highly significant feature of the instant invention is the provision of drip contour means which effectively prevents water from running by capillary action along the bottom surface of a structural slab. The provision of a drip contour and retaining means with a similar cross-sectional configuration enables a single barrier strip to advantageously accomodate flexible receiving means having an appreciably different thickness.

In describing the invention, reference has been made to a preferred embodiment. Those skilled in the art, however, and familiar with the disclosure of the subject invention, may recognize additions, deletions, modifications, substitutions and/or other changes which will fall within the purview of the invention as defined in the following claims.

What is claimed is:

1. Apparatus for collecting fluid seepage in a building structure or the like wherein said structure is constructed, at least in part, with generally horizontal slabs having separations therein such as expansion joints and/or stress developed cracks which occasionally permit fluid seepage through said slabs, said apparatus comprising:

a first elongated barrier strip means operably positioned completely beneath a bottom surface of a generally horizontal slab along one edge of a separation therein;

mounting means connected to said first barrier strip means for fixedly connecting said first barrier strip to the bottom surface of said slab;

a second elongate barrier strip means operably positioned completely beneath a bottom surface of said generally horizontal slab along the other edge of the separation therein;

mounting means connected to said first barrier strip means for fixedly connecting said second barrier strip to the bottom surface of said slab;

flexible receiving means connected between said first and second elongate barrier strip means and operably extending coextensively with said barrier strip means and beneath the separation in said slab;

said first elongate barrier strip means having, a first elongate base member operably connected completely beneath the bottom surface of the generally horizontal slab, a first retaining means fashioned along one edge of said first base member for engaging and holding one edge of said flexible receiving means, and a first drip contour means fashioned along the other edge of said first base member and being operable to be mounted upon the bottom surface of said slab with said first drip contour means disposed beneath said slab and adjacent one side of the separation in said slab; and said second elongate barrier strip means having, a second elongated base member operably connected completely beneath the bottom surface of the generally horizontal slab, a second retaining means fashioned along one edge of said second base member for engaging and holding the other edge of said flexible receiving means, and a second drip contour means fashioned along the other edge of said second base member and being operable to be mounted upon the bottom surface of said slab with said second drip countour means disposed beneath said slab and adjacent the other side of the separation in said slab wherein fluid seeping through the separation in said slab will encounter either said first or said second contour means and drip downwardly therefrom into said receiving means.

2. Apparatus for collecting fluid seepage in a building structure or the like as defined in claim 1 and further comprising:

sealant means operably extending between said building slab and each of said first and second drip contour means to insure the fluid barrier integrity of said first and second barrier strip means.

3. Apparatus for collecting fluid seepage in a building structure or the like as defined in claim 1 wherein said first and second drip contour means each comprise:

at least one arcuate contoured lip downwardly projecting from said associated base members.

4. Apparatus for collecting fluid seepage in a building structure or the like as defined in claim 3 wherein said at least one arcuate contoured lip comprises:

a pair of arcuate contoured lips downwardly projecting from said associated base members and said lips being mutually opposing with an equal radius of curvature.

5. Apparatus for collecting fluid seepage in a building structure or the like as defined in claim 1 wherein said first and second retaining means each comprise:

a generally C-shaped channel fashioned with mutually opposing arcuate lips and projecting downwardly from said associated base and being operable to retain an edge of said flexible receiving means within the confines of said arcuate lips.

6. Apparatus for collecting fluid seepage in a building structure or the like as defined in claim 5 wherein said first and second drip contour means each comprise:

at least one arcuate contoured lip downwardly projecting from said associated base members.

7. Apparatus for collecting fluid seepage in a building structure or the like as defined in claim 6 wherein said at least one arcuate contoured lip comprises:

a pair of arcuate contoured lips downwardly projecting from said associated base members and said lips being mutually opposing with an equal radius of curvature.

8. Apparatus for collecting fluid seepage in a building structure or the like as defined in claim 7 wherein:

said C-shaped channels of each of said first and second mounting means and said pair of arcuately contoured lips of each of said first and second drip contour means are similar in structural configuration but with different radii of curvature such that said mounting means and said drip contour means may be functionally interchanged by positioning said barrier strips on opposite sides of the separation in said slab and concomitantly accomodate a flexible collection means of a different thickness within the confines of said retaining means.

* * * * *